United States Patent [19]

Takenoya et al.

[11] 4,343,249

[45] Aug. 10, 1982

[54] STITCH-LENGTH CORRECTING SEWING MACHINE AND STITCH-LENGTH MEASURING PRESSER FOOT ASSEMBLY USED THEREIN

[75] Inventors: Hideaki Takenoya; Eiichi Shomura, both of Hachioji, Japan

[73] Assignee: Janome Sewing Machine Co. Ltd., Tokyo, Japan

[21] Appl. No.: 169,935

[22] Filed: Jul. 17, 1980

[30] Foreign Application Priority Data

Jul. 18, 1979 [JP] Japan ..... 54-90299
Jul. 18, 1979 [JP] Japan ..... 54-90300

[51] Int. Cl.[3] ..... D05B 3/02; D05B 35/12

[52] U.S. Cl. ..... 112/158 E; 112/314

[58] Field of Search ..... 112/158 E, 158 B, 314, 112/315, 235, 240, 121.11

[56] References Cited

U.S. PATENT DOCUMENTS

| | | | |
|---|---|---|---|
| 3,867,889 | 2/1975 | Conner, Jr. | 112/121.11 |
| 4,182,249 | 1/1980 | Matumura et al. | 112/158 B |
| 4,216,732 | 8/1980 | Marsh et al. | 112/158 B |
| 4,232,617 | 11/1980 | Garron | 112/158 E X |
| 4,236,469 | 12/1980 | Takenoya et al. | 112/314 X |

*Primary Examiner*—Peter P. Nerbun
*Attorney, Agent, or Firm*—Michael J. Striker

[57] ABSTRACT

A stitch-length correcting sewing machine and a stitch-length measuring presser foot assembly used therein are disclosed. The sewing machine and presser foot assembly enables stitches of a predetermined length to be sewn, without the necessity of stitching a trial stitch on a piece of fabric and adjusting the sewing machine to compensate for variations in fabric type and thickness. The presser foot assembly utilizes a presser foot which is detachably securable to a presser bar. A movable presser frame slides on the presser foot as fabric is fed. A potentiometer is fixed to the presser foot and responds to sliding of the presser frame so as to enable distance moved by the presser frame to be ascertained by detecting the resistance of the potentiometer. The presser foot assembly can be used as a fabric sensor responsive to fabric motion in an electronic sewing machine. This enables fabric feed (and, optionally, needle swing) to be varied in accordance with actual motion of the fabric to sew stitches of a predetermined length and to further sew patterns which are properly balanced, independently of fabric type and fabric thickness.

9 Claims, 5 Drawing Figures

1 Start
2 Read out of (PS)
3 Connection & set of (R)
5 Read out of (ROM)
6 Drive of (MB), one stitch
7 Buttonhole stitching
11 Drive of (MF)
13 Read out of (ROM)
14 Drive of (MB), one stitch
24 Sewing machine stops
29 Drive of (MF)
30 Read out of (ROM)
31 Drive of (MB), one stitch
38 First bar tack
41 Drive of (MF)
42 Read out ot (ROM)
43 Drive of (MB), one stitch
50 Second bar tack

STITCH-LENGTH CORRECTING SEWING MACHINE AND STITCH-LENGTH MEASURING PRESSER FOOT ASSEMBLY USED THEREIN

BACKGROUND OF THE INVENTION

1. Field of the Invention

The invention relates to an electronic control sewing machine with the stitch forming instrumentalities which are electronically controlled to change the relative positions between fabric to be sewn and a needle, to thereby produce a pattern of stitches. More particularly, the invention relates to a sewing machine which is capable of designating the length of a pattern from its initial stitch to its final stitch to form a pattern of a designated length, and which then stops the sewing machine after the pattern has been produced. Namely the invention produces only one pattern of a predetermined size and then automatically stops.

2. DESCRIPTION OF THR PRIOR ART

An electronic control sewing machine can produce one selected pattern, and can be stopped immediately afterwards. However, when forming a combined series pattern of like patterns or of different patterns, it becomes necessary to designate the size of each pattern because of the space of fabric or of the mutual balance between the patterns forming the combined pattern. Such a requirement cannot, however, be satisfied by any conventional sewing machines. For example, even if the number of stitches are designated to form a predetermined size of button holes, the same sized button holes are not always produced due to the differences in the thickness and kind of fabric to be sewn. It has, therefore, been necessary to make a trial stitching for confirmation of actual stitch size.

SUMMARY OF THE INVENTION

The present invention has been devised to eliminate such shortcomings of the prior art. That is to say, it is a primary object of the invention to set a size of a pattern by means of a presser foot attachment which is movable with the fabric, and to electrically detect the set value and the moving amount of the fabric, so that the fabric feeding pitch may be set in accordance with said set value, and the feeding pitch may be amended in response to the actual motion of the fabric, whereby the pattern may be of the designated length and the sewing machine is stopped after the pattern has been formed.

It is a second object of the invention to heighten sewing efficiency.

It is a third object of the invention to simplify the control structure as well as the operation thereof.

Many other features and advantages of the invention will be apparent from the following description of a preferred embodiment in reference to the attached drawings.

DETAILED DESCRIPTION OF PREFERRED EMBODIMENTS

Figure 1:
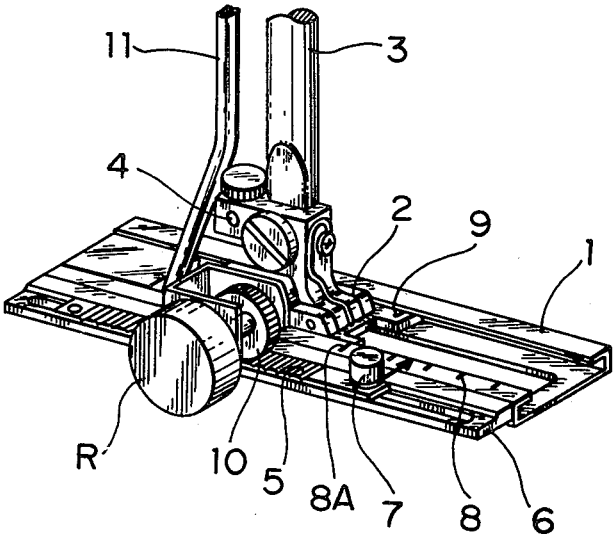
FIG. 1 is a drawing of a fabric presser foot attachment employed in the invention and attached to a presser bar of a sewing machine.

The present invention will be discussed with reference to the drawings. FIG. 1 shows a fabric presser foot 2 and other elements used in the invention attached to a sewing machine (not shown). Presser frame 1 is provided, at the underside thereof, with a substance having a large frictional resistance such as rubber (not shown) for preventing slippage between the presser foot attachment and the fabric to be sewn. The numeral 2 is a presser foot secured to a presser holder 4, which latter is screwed to a presser bar 3. The presser frame 1 is held by the presser foot 2 and is movable to the right and left in FIG. 1. The numeral 5 is a rack formed on a guide plate 6 fixed to the presser frame 1, which rack 5 is held by the guide plate 6 and is movable right and left in FIG. 1. The numeral 7 is a thumbscrew for the rack 5. The thumbscrew 7 is tightened and fixed at a desired position relative to scales 8 marked on the presser frame 1 for designating the length of a pattern to be stitched, so that the rack 5 is secured to the presser frame 1 at a desired position. The presser foot 2 is provided with a mark 9 indicating the needle dropping positions in straight and zigsag stitching. A spring (not shown) is provided between the presser foot 2 and the presser frame 1 to bias the presser frame 1 toward the right in FIG. 1 until the presser frame 1 abuts a stop (not shown) at the position shown, where the 0 point 8A of the scale 8 is aligned with the mark 9. The presser frame 1 is moved to the left against the spring together with the fabric as the fabric advances during stitching. When thumbscrew 7 reaches the needle dropping mark 9, the sewing machine is stopped. (R) is a rotational potentiometer mounted on the presser foot 2, and has a pinion 10 mounted on its shaft. The pinion 10 is in mesh with the rack 5. By fixing thumbscrew 7 to one of the scales 8, the initial position of the potentiometer (R) is set. In the invention, when thumbscrew 7 reaches mark 9, the sewing machine is automatically stopped. The numeral 11 is a lead wire of the potentiometer (R) which is detachably connected, through a connector (not shown), to a later mentioned control device housed in the machine housing. A linear potentiometer may be used instead of the rotational potentiometer (R). In this case, the rack 5 is not used and a wiper of the linear potentiometer is positioned at point 8 on the presser frame 1.

Figure 2:
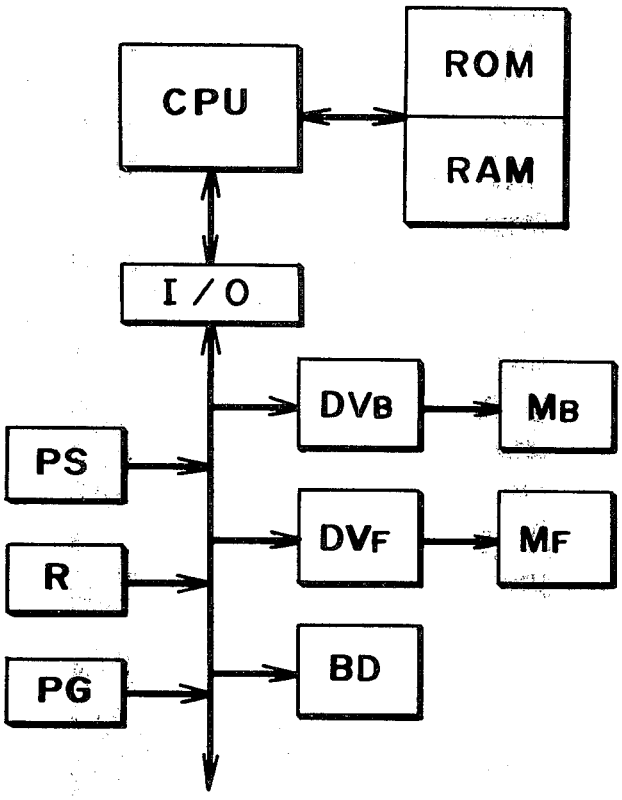
FIG. 2 is a block diagram of a control circuit use in the invention.

FIG. 2 is the block diagram of a control circuit, in which ROM is a read-only-memory which stores a plurality of the stitch pattern control signals, including the button hole stitch signals and program control signals. CPU is a central processing unit for each of program controls. RAM is a random-access-memory which temporarily stores the process of programming operations and the results thereof. I/O is an input-output port. ROM, CPU, RAM and I/O constitute a microcomputer. PS is a pattern selector including pattern selecting switches (not shown), which stitches are located at the top of the sewing machine. When a desired pattern is selected, a result thereof is stored in RAM. PG is a pulse generator which issues a pulse on each rotation of the upper shaft of the sewing machine. The pulse is applied to CPU for reading out the stitch control signals from ROM. $DV_B$ and $DV_F$ are electric driving parts for controlling the needle swinging amplitude and the fabric feeding movement. The driving parts $DV_B$ and $DV_F$ drive a needle swing control motor $M_B$ and a fabric feed control motor $M_F$ respectively in accordance with the signals from CPU. BD is a stopping device which brakes a machine motor (not shown) in accordance with the signal from CPU, and stops the needle at a predetermined position, e.g., at its upper dead point.

Figure 3:
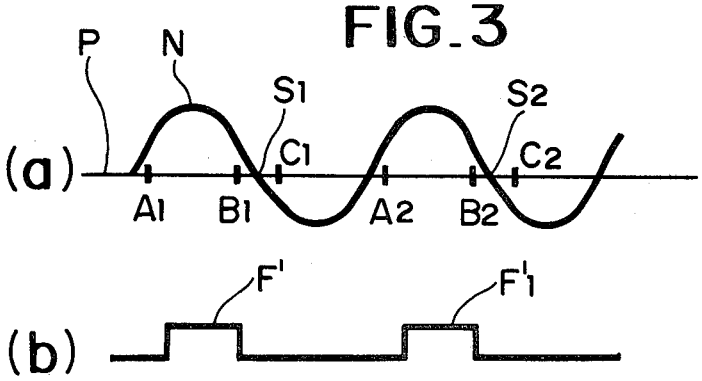
FIG. 3 is a control timing diagram.

ROM stores the needle swing control signals and the fabric feed control signals with respect to one of the addresses. FIG. 3 shows the relation between the reading-out of the control data and the working of ROM. In FIG. 3(*a*), (P) is an upper surface of the needle plate, and (N) is the vertical movement locus of the point of the needle. While the sewing machine is driven at a constant speed, ($A_1$) ($A_2$) . . . show times for reading out control data for the needle and the fabric feed from ROM. If a pattern is selected at the time $A_1$, for example, the control data are read out during the whole time when the needle point (N) is positioned above the needle plate (P) after the time (A). The needle control data read out at the time (A) instantly drives the needle control motor $M_B$ and determines the needle sewing position ($S_1$) where the needle penetrates the fabric. FIG. 3(*b*) shows that the feed dog transports the fabric during intervals (F', $F'_1$) while the needle is above the needle plate (P) in FIG. 3(*a*). The feed control data of the fabric read out at the time ($A_1$) drives the fabric feed control motor $M_F$ at a phase where the needle is subsequently positioned under the needle plate (P) in order to control a feed regulator (not shown) and carries out, at the convex part ($F'_1$), the fabric feed from the initial needle penetration point ($S_1$) to the second penetration point ($S_2$).

Figure 4A:
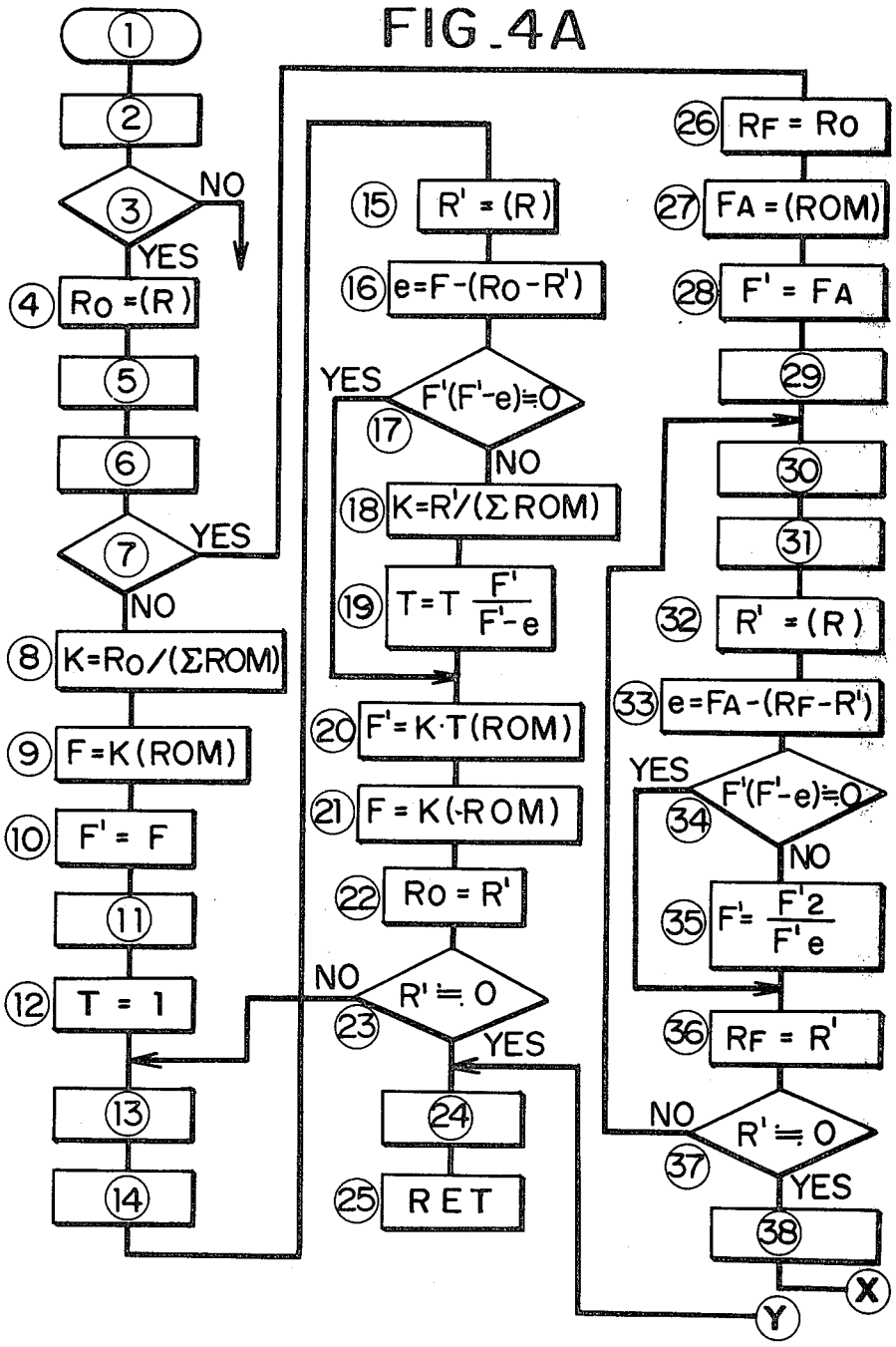
FIGS. 4A and 4B are a flow chart used in the operation of the invention.
Figure 4B:
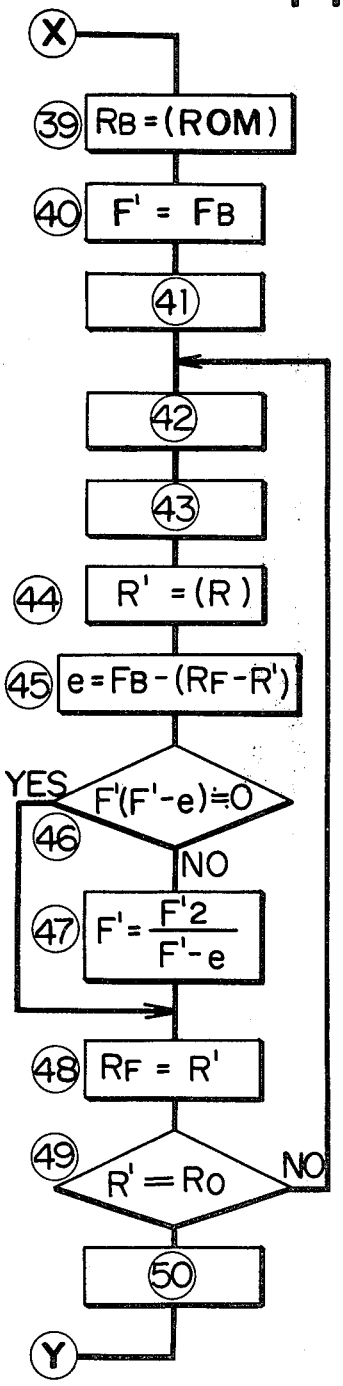

The operation of the above mentioned structure will be explained with reference to the flow chart in FIG. 4. When the control power source is turned on, the control circuit in FIG. 2 is also turned on and a program starts to run. The CPU reads out the selection of the pattern selecting part PS, confirms that the potentiometer (R) is connected to the control circuit via the lead wire 11, and further confirms that the rack 5 is fixed by thumbscrew 7 relative to the scale 8 at a position corresponding to the minimum controllable length of the selected pattern. For example, it is determined if the rack 5 is set to produce a button hole of a predetermined length. If rack 5 is so set, the CPU reads out the initial set value Ro of the potentiometer (R) corresponding to the fixed position of thumbscrew 7, and stores this initial set value. If rack 5 is not so set, the normal continous stitching is carried out in a routine (not shown). CPU then reads out the stitch control data of ROM at, e.g., time $A_1$ while the needle is positioned above the needle plate (P), and controls the needle swing control motor $M_B$ to thereby determine the initial needle position. If a machine controller (not shown) is operated, the needle stitches at the initial point ($S_1$). If a pattern other than the button hole had been selected, CPU calculates a ratio K between the length of the pattern designated by the initial set value Ro of the potentiometer R and the algebraic sum Σ ROM of each stitch length read out from ROM with respect to the selected pattern. This indicates the ratio of the length of the pattern designated by thumbscrew 7 to the standard length of the pattern selected. The data for the initial fabric feed read out from ROM is multiplied by the ratio K to provide a designated stitch length control data F in order to control the initial fabric feed. Since a designated stitch length control data F' is employed during the second and later stitches in accordance with a correction coefficient which is based on actual measurement of stitch length, the data F is replaced by the data for the initial fabric feeding, and the fabric feed control motor $M_F$ is driven at the time ($C_1$) by the data F'. T in FIG. 4 is the above mentioned correction coefficient, and it is set to 1 for carrying out a later mentioned calculation. Next the CPU reads out the second stitch control data of ROM at the time ($A_2$) to drive the motor $M_B$ in accordance with the needle control data for the second stitch. As the machine is rotated, the feed control data drives the motor $M_F$ to control the movement of the feed dog during interval ($F'_1$) while the needle is located above the needle plate (P), and the needle comes to penetration ($S_2$) as is shown in FIG. 3. At the time ($B_2$) when the fabric feed is finished, the resistance of potentiometer (R) is read out and it is stored as (R'). In the instant embodiment, the fabric feed at the time ($B_1$) is based on the information of the fabric feed of the pattern selected prior to a new pattern selection. However, the presser frame 1 is pressed against the fabric after the initial needle dropping position is at time ($B_1$) confirmed, that is, after the fabric feed is finished and prior to the new pattern selection. Therefore, the initial fabric feed of a new pattern will not be influenced by the information prior to the new pattern selection. Subsequently, the CPU computes the difference between the fabric feed designation F and the actual movement RO–R' of the potentiometer (R) that is, the erroneous difference (e). Then the CPU confirms that F' and F' —(e) are not 0 for a subsequent control, and sets a new ratio K between said R' and the remaining algebraic sum Σ ROM after subtraction of the fabric feed which has actually been carried out. The error coefficient T is then used to compute a new amended coefficient T which is to be altered by the difference (e), to thereby determine a newly amended stitch length control data F'. When either F' or F' —(e) is near O, that is, when the fabric feed designation is 0 or when the potentiometer (R) is only slightly moved, the previous data is used instead of newly computing the ratio K and the error coefficient T. Then a new ratio K is used to obtain an error (e) in a next step in order to determine a designated stitch length control data F as mentioned above. New R' is set as Ro to obtain a difference L and a ratio K in the next step. If R' is not 0, the stitches progress by repeating the steps after the reading out of ROM, and when the resistance of the potentiometer (R) becomes 0, all the stitches of one pattern are completed, thumbscrew 7 is aligned with the mark 9, the stopping device BD is operated to stop the sewing machine with the needle positioned at its upper dead point, and the program returns to the start RET. When the presser bar 3 is lifted up, the presser frame 1 is separated from the fabric, and the potentiometer (R) returns to its initial setting. Said times ($A_1$) ($A_2$) . . . ($B_1$) ($B_2$) are detected by the pulse generator PG of the upper shaft.

Reference will now be made to the stitches of a button hole as one of applied cases of the present invention. The button hole is formed with left line tack stitches, first bar tack stitches, right line tack stitches and second bar tack stitches. When the button hole stitching is selected by the pattern selecting part PS, the needle penetrates the fabric at the point ($S_1$), and then the initial setting value RO of the potentiometer (R) is stored as $R_F$. Subsequently, a standard fabric feed control data $F_A$ stored in ROM for the left line tack stitches is replaced by F' which is designated stitch length control data chosen in view of the amending coefficient based on the actual measurement of the later mentioned second stitch. The data F′ is used in place of the data $F_A$ without amendment for the first feeding. The fabric feed control motor $M_F$ is driven in accordance with the data F′ at the time ($C_1$). The second stitch control data in ROM is read out at the time ($A_2$) as mentioned above, and the needle control motor ($M_B$) is driven in accordance with the needle control data for the second stitch. The fabric is transported in the region $F_1'$ as before and the needle reaches the second penetration point ($S_2$). The value of the potentiometer (R) is read out at the time ($B_2$) and it is registered as R′. In the next step, the difference (e) between the standard fabric feed control data $F_A$ of the left line tack stitches and the moving amount $R_F$–R′ of the potentiometer (R) is determined. Then it is confirmed for the subsequent control that F′ and F′—e are not zero, and a new F′, corrected by the difference (e) is computed. If either of F′ or F′—e is near zero, the previous data F′ is used. Subsequently, new R′ is set to equal $R_F$ to compute the next difference (e). If R′ is not 0, the steps after the reading out of ROM are repeated to advance the stitches until the resistance of the potentiometer (R) becomes 0. Then all the left line tack stitches are finished, thumbscrew 7 is aligned with the mark 9, and the program goes on to execute the first bar tack stitches, the details of the execution being omitted to simplify the description of the invention. It is, however, to be noted that the fabric feeding coordinates of the start and the end are assumed to coincide with each other. When the first bar tack stitching is finished, the right line tack stitching is started, in the same manner as in the left line tack stitching, by using the standard fabric feed control data $F_B$ stored in ROM. If the resistance of the potentiometer (R) comes to the initial set value R0, this indicates that the fabric feed coordinate has returned to the initial stitching position of the button hole, and that the desired length of the right line tack stitches has been attained. After the second bar tack stitches are formed, the stopping device BD is operated to stop the sewing machine with the needle positioned at its upper dead point, and the program returns to the start. According to the invention, the standard fabric feed control data F is stored in ROM, so as to be read out therefrom in the normal selection of the button hole stitches. It is, however, possible to manually modify the value, if it becomes necessary.

As mentioned above, according to the invention, if a pattern is selected and the length of the pattern is set in the direction of feed, the fabric feed is controlled on the basis of actual stitch length, and therefore, the pattern is produced with a desired length, regardless of the thickness and kind of the fabric. Therefore, for forming a combined pattern in combination of different patterns, the balance between the patterns is optimally provided, and the structure is simple and operation of the control is easy.

We claim:

1. A sewing machine, comprising: stitch forming means including a needle to effect sewing a fabric; feeding means for moving said fabric relative to said needle; a pressor foot for pressing against said fabric; an electronic memory means for storing stitch control data for different stitch patterns; pattern selecting means for selecting stitch control data for a pattern; a presser frame slidably attached to said presser foot, said presser frame being adapted to slidably move at a pitch equal to a feeding pitch of said fabric during the feeding thereof; sensor means disposed on said presser foot so as to engage said presser frame, said sensor means being adapted to produce electric signals which indicate a position of said presser frame during said movement thereof; and calculating means for calculating a fabric feed control signal for said feeding pitch of said fabric involving a ratio between an initial value defined by said sensor means and the total feeding pitches of a selected pattern stored in said memory, and wherein said fabric control signal is used to control said fabric feeding device.

2. The sewing machine defined by claim 1 wherein said sensor is a potentiometer.

3. The sewing machine defined by claim 2, wherein said potentiometer has a rotatable shaft which is geared to said pressor frame and which rotates with sliding thereof.

4. The sewing machine defined by claim 2, wherein said potentiometer is a linear potentiometer with a movable wiper fixed to said presser frame.

5. The sewing machine defined by claim 1, further including a high-friction substance attached to an underside of said presser frame to prevent slippage between said presser frame and said fabric during fabric feed.

6. The sewing machine defined by claim 1, further including a fixed stop and an adjustable stop, which stops limit said amount to a predetermined desired stitch length.

7. The sewing machine defined by claim 6, wherein said adjustable stop is a thumbscrew.

8. The sewing machine defined by claim 6, further including a spring biasing said presser frame towards said fixed stop and away from said adjustable stop.

9. A sewing machine, comprising stitch forming means including a needle to effect sewing a fabric; feeding means for moving said fabric relative to said needle; a presser foot for pressing against said fabric, an electronic memory means for storing stitch control data for different stitch patterns; pattern selecting means for selecting stitch control data for a pattern; a presser frame slidably attached to said presser foot, said presser frame being adapted to slidably move at a pitch equal to a feeding pitch of said fabric during the feeding thereof; sensor means disposed on said presser foot so as to engage said presser frame, said sensor means being adapted to produce electric signals which indicate a position of said presser frame during said movement thereof; and calculating means, said calculating means comparing a first calculated feed control signal and a feed back signal provided by said sensor means during the stitching operation, said calculating means calculating from said latter compared signals a different control signal to substantially equal said first calculated control signal.

* * * * *